US007536842B2

(12) United States Patent
Ponti

(10) Patent No.: US 7,536,842 B2
(45) Date of Patent: May 26, 2009

(54) MACHINE AND A METHOD FOR FILLING BOX-LIKE CONTAINERS WITH ARTICLES ARRANGED SIDE BY SIDE AND VERTICALLY

(75) Inventor: Francesco Ponti, Cerbara-Citta'di Castello (IT)

(73) Assignee: C.M.C. S.r.l., Cerbara-Citta'di Castello (Perugia) (IT)

( * ) Notice: Subject to any disclaimer, the term of this patent is extended or adjusted under 35 U.S.C. 154(b) by 0 days.

(21) Appl. No.: 11/815,634

(22) PCT Filed: Feb. 16, 2006

(86) PCT No.: PCT/IB2006/000307

§ 371 (c)(1),
(2), (4) Date: Aug. 6, 2007

(87) PCT Pub. No.: WO2006/087622

PCT Pub. Date: Aug. 24, 2006

(65) Prior Publication Data

US 2008/0141619 A1 Jun. 19, 2008

(30) Foreign Application Priority Data

Feb. 17, 2005 (IT) ..... BO2005A0077

(51) Int. Cl.
*B65B 5/10* (2006.01)
*B65B 35/30* (2006.01)
*B65B 39/12* (2006.01)
*B65G 47/26* (2006.01)

(52) U.S. Cl. ..... 53/475; 53/158; 53/248; 53/251; 198/418; 198/431

(58) Field of Classification Search ..... 53/244, 53/246, 248, 249, 250, 251, 255, 158, 169, 53/475, 473; 198/418.4, 418.7, 426, 429, 198/431

See application file for complete search history.

(56) References Cited

U.S. PATENT DOCUMENTS 2,233,850 A * 3/1941 Rapley ..... 198/408

(Continued)

FOREIGN PATENT DOCUMENTS

EP 551613 A1 * 7/1993

OTHER PUBLICATIONS

International Search Report.

*Primary Examiner*—Paul R Durand
(74) *Attorney, Agent, or Firm*—William J. Sapone; Coleman Sudol Sapone P.C.

(57) ABSTRACT

In a machine for filling box-like containers with articles arranged side by side and vertically, a station (1) forms a row (11) of articles (10), overlapped at least partially. An article feeding apparatus (2), functionally interposed between the outlet section of the forming station (1) and a filling station (3), operates between a rest configuration (I) and a work configuration (A). When in the work configuration, the apparatus transfers the articles (10) from the outlet section into a box-like container (4), placed in the filling station (3), and directs the articles in a vertical orientation, to define a prefixed filling condition of the first container (4). A conveyor (5) supports the series of box-like containers and is operated, in step relation with the speed of feeding of the articles (10), fed by the articles feeding apparatus (2), so as to move the box-like containers in a container feeding direction (G).

11 Claims, 7 Drawing Sheets

U.S. PATENT DOCUMENTS 3,147,846 A * 9/1964 Huntoon ..... 53/248
3,359,874 A * 12/1967 Stegenga et al. ..... 198/418.9
3,932,982 A * 1/1976 Klapp ..... 53/244
4,226,073 A * 10/1980 Rose et al. ..... 53/532
4,237,677 A * 12/1980 Klapp ..... 53/505
4,241,559 A * 12/1980 Klapp ..... 53/244
4,676,050 A * 6/1987 Odenthal ..... 53/447
5,212,930 A * 5/1993 Raudat ..... 53/263
5,588,285 A * 12/1996 Odenthal ..... 53/534
5,768,856 A * 6/1998 Odenthal ..... 53/443
6,546,698 B1 4/2003 Focke et al.
2003/0233815 A1 * 12/2003 Klapp et al. ..... 53/542
2003/0233816 A1 12/2003 Klapp et al.
2004/0098948 A1 * 5/2004 Caporali et al. ..... 53/443
2004/0187447 A1 9/2004 Byrd et al.
2005/0229548 A1 * 10/2005 Hooper ..... 53/475

* cited by examiner

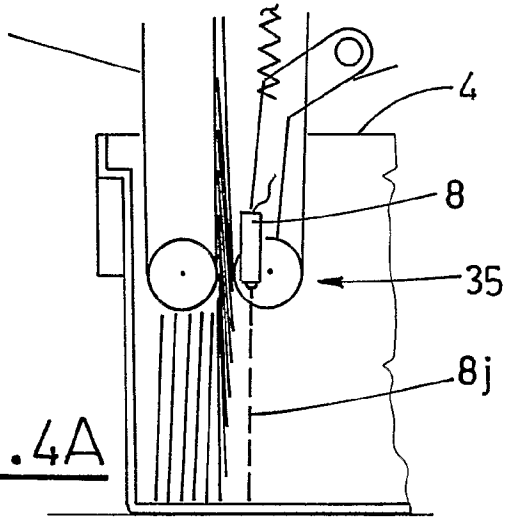
FIG.4A
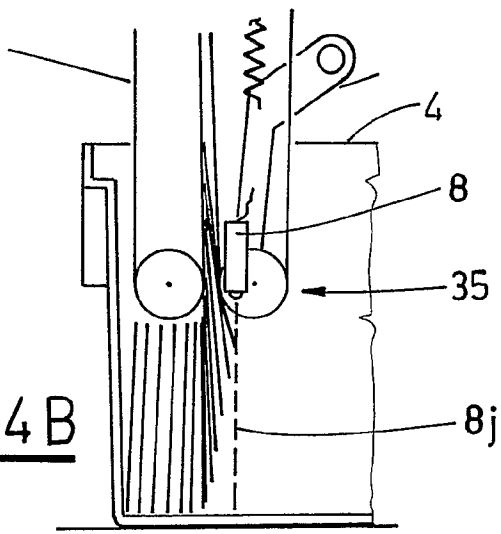
FIG.4B
FIG.3A
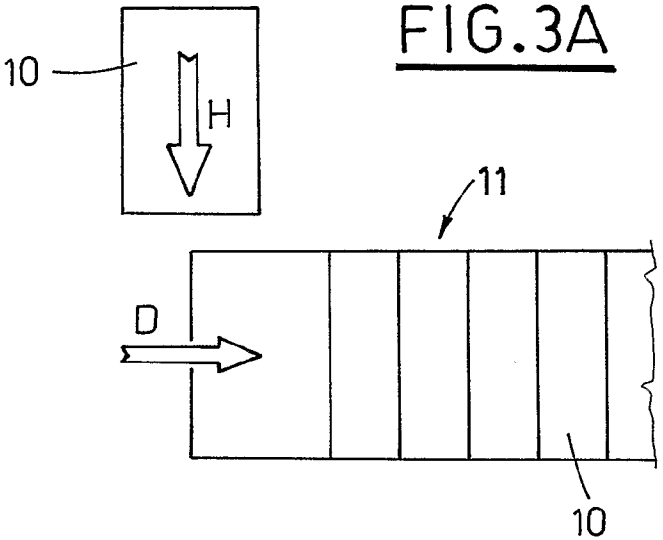
FIG.3B
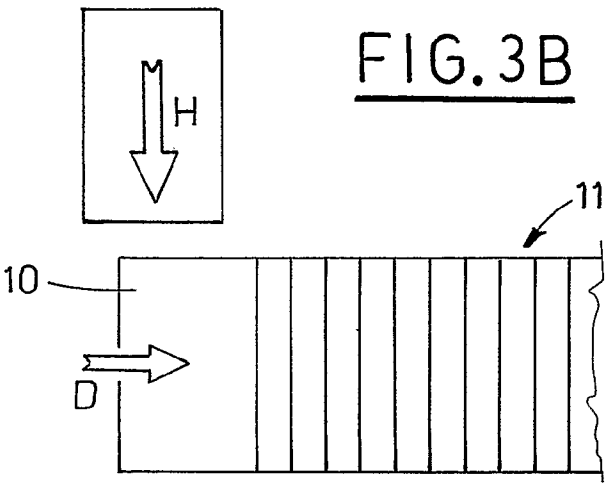

MACHINE AND A METHOD FOR FILLING BOX-LIKE CONTAINERS WITH ARTICLES ARRANGED SIDE BY SIDE AND VERTICALLY

FIELD OF THE INVENTION

The present invention relates to automatic machines for receiving articles, in particular envelopes, and for placing them in box-like containers, arranged side by side and vertically.

BACKGROUND OF THE INVENTION

Industrial processes are known, which transfer envelopes from a feeding line, e.g. conveying means, to corresponding receiving magazines, the so-called "stackers", where the envelopes are piled up in metallic baskets, whose dimensions are adapted to the dimensions of envelopes.

The latter, housed in the baskets, are then picked up by mechanical arms, which place them inside box-like containers, disposed side by side and vertically.

However, these processes must be interrupted when the envelope size is changed: in fact, in these cases, an operator must intervene manually to adapt the dimensions of the baskets to the new dimensions of the envelopes, which are to be housed there, which results in a waste of time.

SUMMARY OF THE INVENTION

The object of the present invention is to propose a machine for filling box-like containers with articles arranged side by side and vertically, which is capable of transferring articles, in particular envelopes, from a feeding line to relevant box-like containers, where they are arranged side by side, vertically.

Another object of the invention is to propose a compact machine, whose dimensions are reduced and structure is essential, and which is capable of fulfilling the proper functions of the apparatuses of prior art.

A further object of the present invention is to propose a machine, in which the flow of articles, coming from the feeding line, does not have to be stopped, or slowed down, when a container full of articles is substituted with an empty one.

A still further object of the present invention is to propose a machine which resolves the above mentioned drawbacks, thus giving an automation degree and productive performance superior than the apparatuses of prior art.

Yet a further object of the present invention is to propose a machine, whose costs are relatively limited with respect to the obtained results.

Another object of the present invention is to propose a method, which allows box-like containers to be filled with articles, such as envelopes, arranged vertically, side by side thereinside, fed from article feeding line, with a cyclical and automatic process, with said method assuring high processing rates and not requiring slowing down or stopping of the flow of articles coming from the feeding line.

The above mentioned objects are obtained, in accordance with the claims, by a machine for filling box-like containers with articles arranged side by side and vertically, characterized in that it includes:

a row forming station for forming a row of articles, overlapped at least partially, on first conveying means for transferring the row toward an outlet section of the row forming station, in a forward direction;

an article feeding apparatus, functionally interposed between said outlet section of said row forming station and a filling station, and operating between a rest configuration and a work configuration, with said apparatus taking the work configuration for transferring said articles from said outlet section into a box-like container, belonging to a series of box-like containers, placed in said filling station, and directing said articles in a vertical orientation to define a prefixed filling condition of the first container;

first means for supporting said series of box-like containers, arranged one after another, and for moving the latter in a feeding direction, in step relation with the speed of feeding of said articles, fed by the article feeding apparatus.

The above mentioned machine is conceived to carry out a method for filling box-like containers with articles arranged side by side and vertically by means of an article feeding apparatus and first means for supporting and moving box-like containers, characterized in that it includes the following steps:

said article feeding apparatus is placed in a position corresponding to a first box-like container, belonging to the series of the box-like containers;

the articles supplied by the article feeding apparatus are inserted into the first box-like container, in a vertical orientation, in step relation with the motion of the first box-like container in a container feeding direction, until a prefixed filling condition of the first box-like container is achieved;

feeding of the articles by the article feeding apparatus is stopped;

said article feeding apparatus is removed from the first box-like container and at least said first box-like container and a second box-like container, belonging to the series of box-like containers and adjacent to the first box-like container, are moved, by the first supporting and driving means in said container feeding direction;

the article feeding apparatus is placed in a position corresponding to the second box-like container.

BRIEF DESCRIPTION OF THE DRAWINGS

The characteristic features of the invention, not resulting from what above, are pointed out in the following, in accordance with the claims and with reference to the enclosed figures, in which:

FIGS. 3A, 3B show roughly the overlapping, which can characterize a row of articles at the machine inlet;

FIGS. 4A, 4B are enlarged views of the particular Z of FIG. 2A, in two subsequent moments;

DISCLOSURE OF THE PREFERRED EMBODIMENTS

Figure 1:
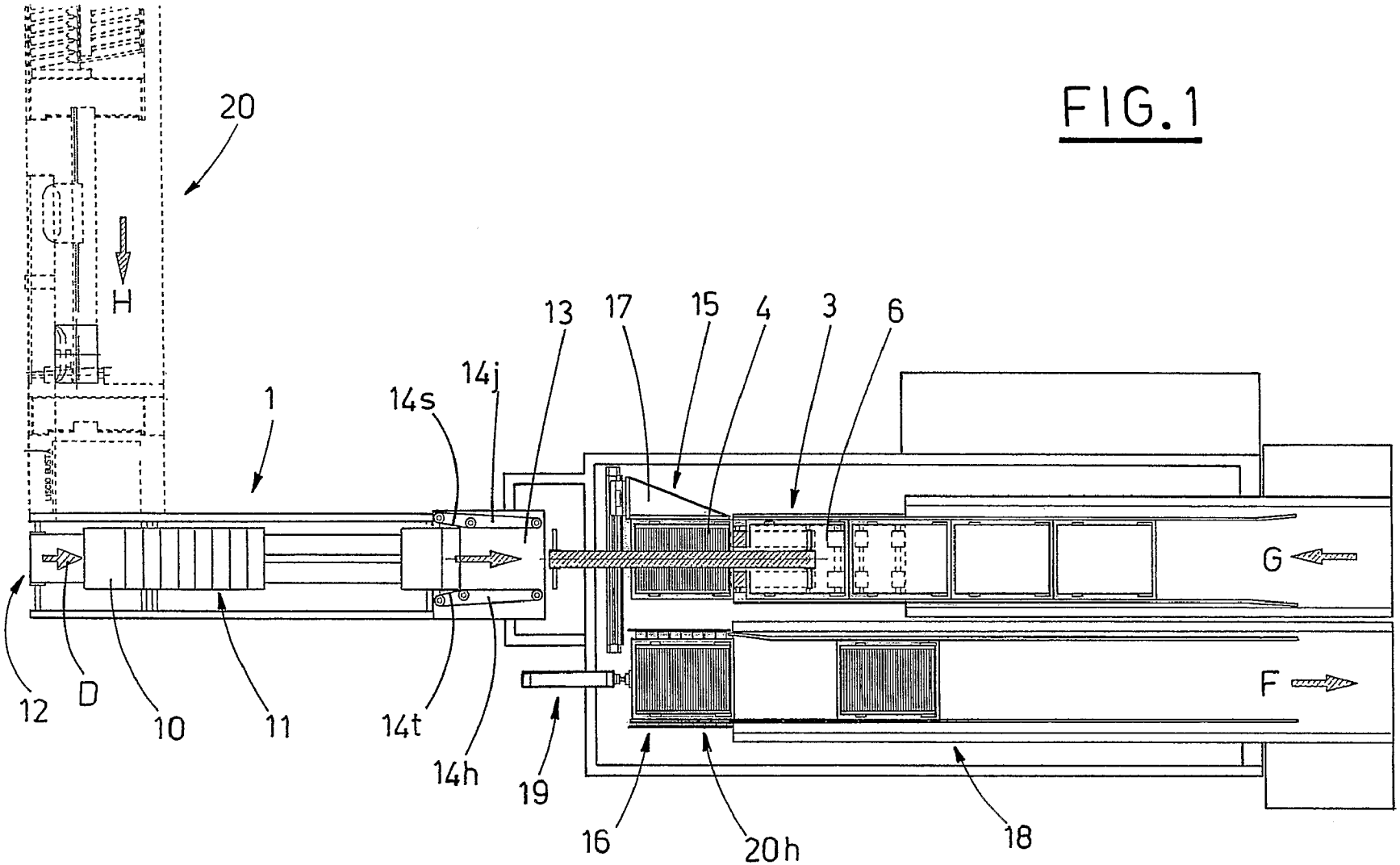
FIG. 1 is a top view of the proposed machine.

With reference to the enclosed Figures, the reference numeral 1 indicates a station for forming a row 11 of articles 10, e.g. envelopes.

The station is defined by: first conveying means 12, aimed at conveying the row 11 in a forward direction D, a support 13, situated in cascade with the first conveying means 12 and second conveying means 14*j*, 14*h*, situated at the sides of the support 13 with respect to the forward direction D, and forming, in the part facing the first conveying means 12, corresponding sloping edges 14*s*, 14*t*.

The reference numeral 2 indicates an apparatus for feeding substantially elongated articles, hinged near the outlet section of the forming station 1, on one side, and supported by the operation means 7, at the other side (see FIGS. 2A, 2B, 2C, 2D).

The activation of the means 7 allows the apparatus for feeding articles 2 to swing with respect to the articulation point 30, through a prefixed angle.

The apparatus for feeding articles 2 includes a pair of conveyors 2*h*, 2*j*, a lower one and an upper one, which extend along the whole length of the apparatus, and which are arranged one with respect to the other to define two runs, facing each other: e.g. the lower conveyor 2*h* is operated by power actuating means, not shown.

As it is seen in the Figures, the pair of conveyors 2*h*, 2*j* receive, at their inlet, the articles 10, in a row and in a horizontal orientation, and releases them at the terminal portion 35 of the apparatus 2, with a vertical orientation.

The numeral 5 indicates first means, e.g. endless conveyor, for supporting and moving a series of box-like containers, arranged one after another and moved in a feeding direction G, by motors 21, of the brushless type, e.g.: in particular, the enclosed Figures show a first box-like container 4 and a second box-like container 6, adjacent and next to the first container 4, both resting on the first means 5 and moved in the feeding direction G.

A first dwelling station 15, e.g. rollers 20*j*, situated in cascade with respect to the first means 5, features first pushing means 17, operating crosswise with respect to the feeding direction G.

A second dwelling station 16, situated beside the first dwelling station 15, is likewise formed by rollers 20*h*, with second pushing means 19 fastened thereto and acting on the box-like containers, placed in the second dwelling station 16, in a feeding direction F, e.g. opposite to the above mentioned feeding direction G.

Second means 18, e.g. endless conveyor, are situated in cascade with respect to the second dwelling station 16, in order to support and move the series of box-like containers, in the above mentioned feeding direction F.

It is to be specified that the rolling belts 20*j*, 20*h* can be substituted by as many motionless surfaces.

Finally, sensor means 8 are connected to the terminal portion 35 of the apparatus for feeding articles 2, in order to detect, through a vertical detecting section 8*j*, the presence of at least one portion of the articles 10, defining a step relation between the feeding apparatus 2 and the first supporting and moving means 5, as it will be better explained later on.

Now, the operation of the machine, proposed by the present invention will be described.

A conveying line 20, indicated generally in FIG. 1 and of known type, transfers the articles 10 on the first conveying means 12, in a feeding direction H, orthogonal to the forward direction D.

In this way, rows 11 of articles 10, partially overlapped, are created on the first conveying means 12, and transferred in the forward direction D.

FIGS. 3A, 3B show, as example, rows 11 of articles 10 formed by combining in different way, the operation speeds of the feeding line 20 and the first conveying means 12.

FIG. 3B shows a more extended overlapping of the articles 10 with respect to what is shown in FIG. 3A; this can be obtained, by e.g. increasing the operation speed of the line 20, or decreasing the operation speed of the first means 12.

The articles 10, overlapped in order to form a row 11, are moved by the first conveying means 12 up to the outlet section, where they are channeled on the support 13, by the second conveying means 14*j*, 14*h*, through the corresponding inclined guide edges 14*s*, 14*t*, and conveyed, by dragging, to the outlet section of the forming station 1.

The apparatus for feeding articles 2 picks up the articles 10 from the outlet section of the forming station 1, transfers them, by the pair of conveyors 2*h*, 2*j*, lower and upper, respectively, to the corresponding outlet section, and places them, with a vertical orientation, inside the box-like containers moved by the first supporting and driving means 5.

The apparatus for feeding articles 2, swings about its articulation point 30, between a work configuration A and a rest configuration 1.

When the apparatus is in the work configuration A, the row of articles 10 is conveyed into the first box-like conveyor 4 (FIG. 2A), until a prefixed filling level is reached and disposed with a vertical orientation (FIG. 2B), and when the apparatus is in the rest configuration 1, it disengages from (FIG. 2C) and engages (FIG. 2D) respectively with the first container 4 and with the second box-like container 6.

The above operations are performed by the feeding apparatus 2 in a cyclical and repetitive way on the box-like containers moved by the first supporting and driving means 5, in step relation with the operation of the latter.

Figure 2A:
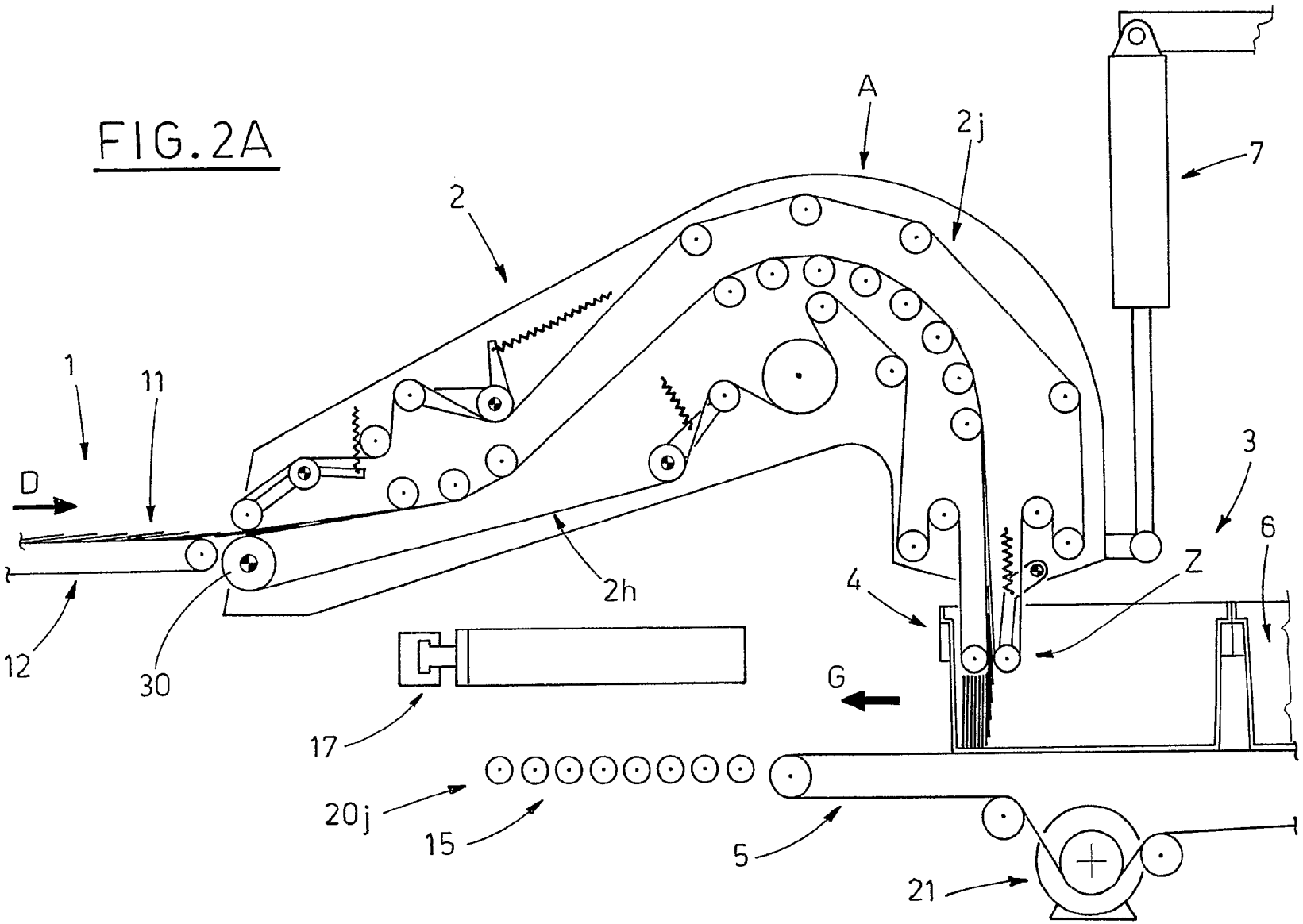
FIGS. 2A, 2B, 2C, 2D are schematic, lateral views of a working cycle of the machine.
Figure 2B:
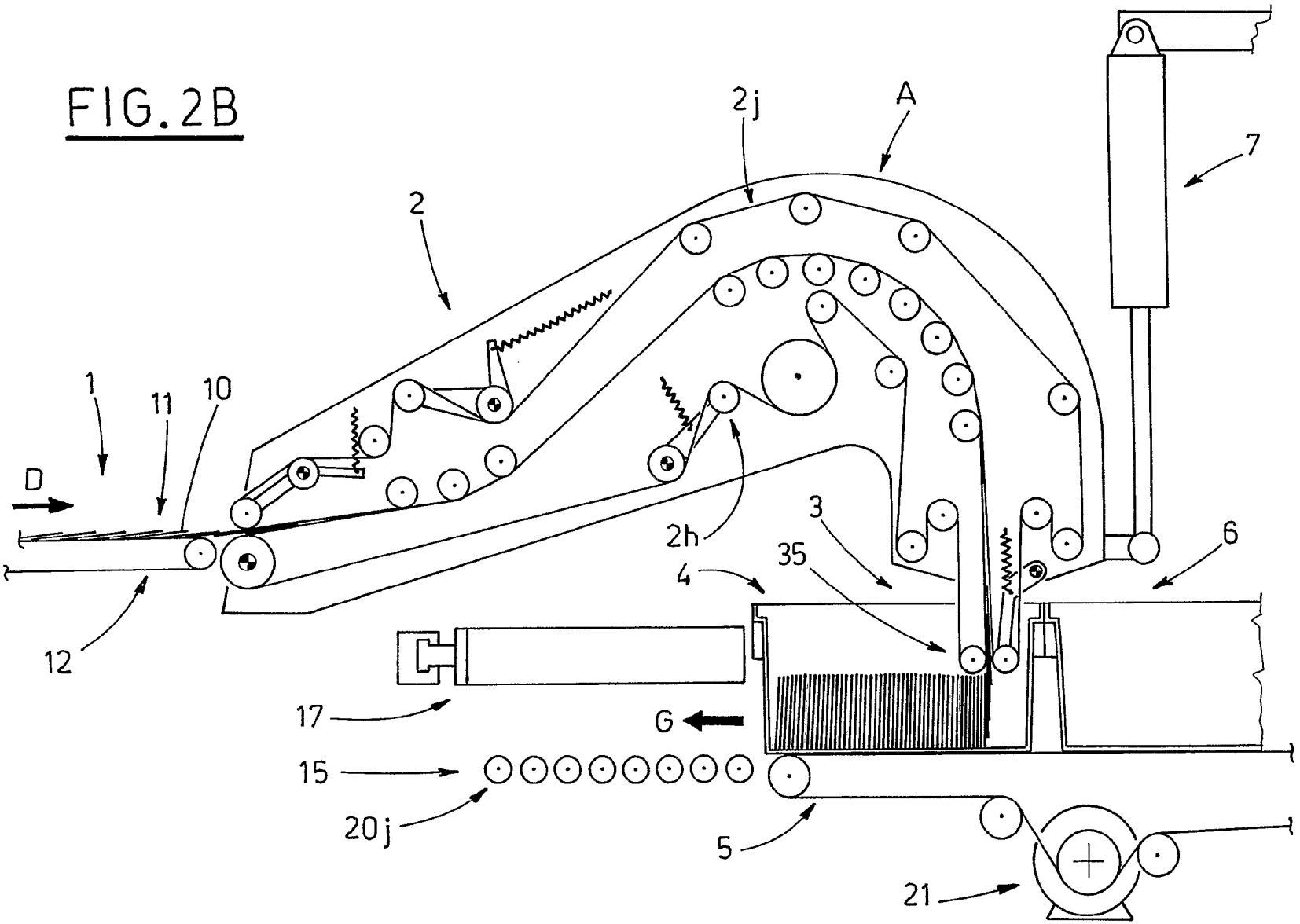
Figure 2C:
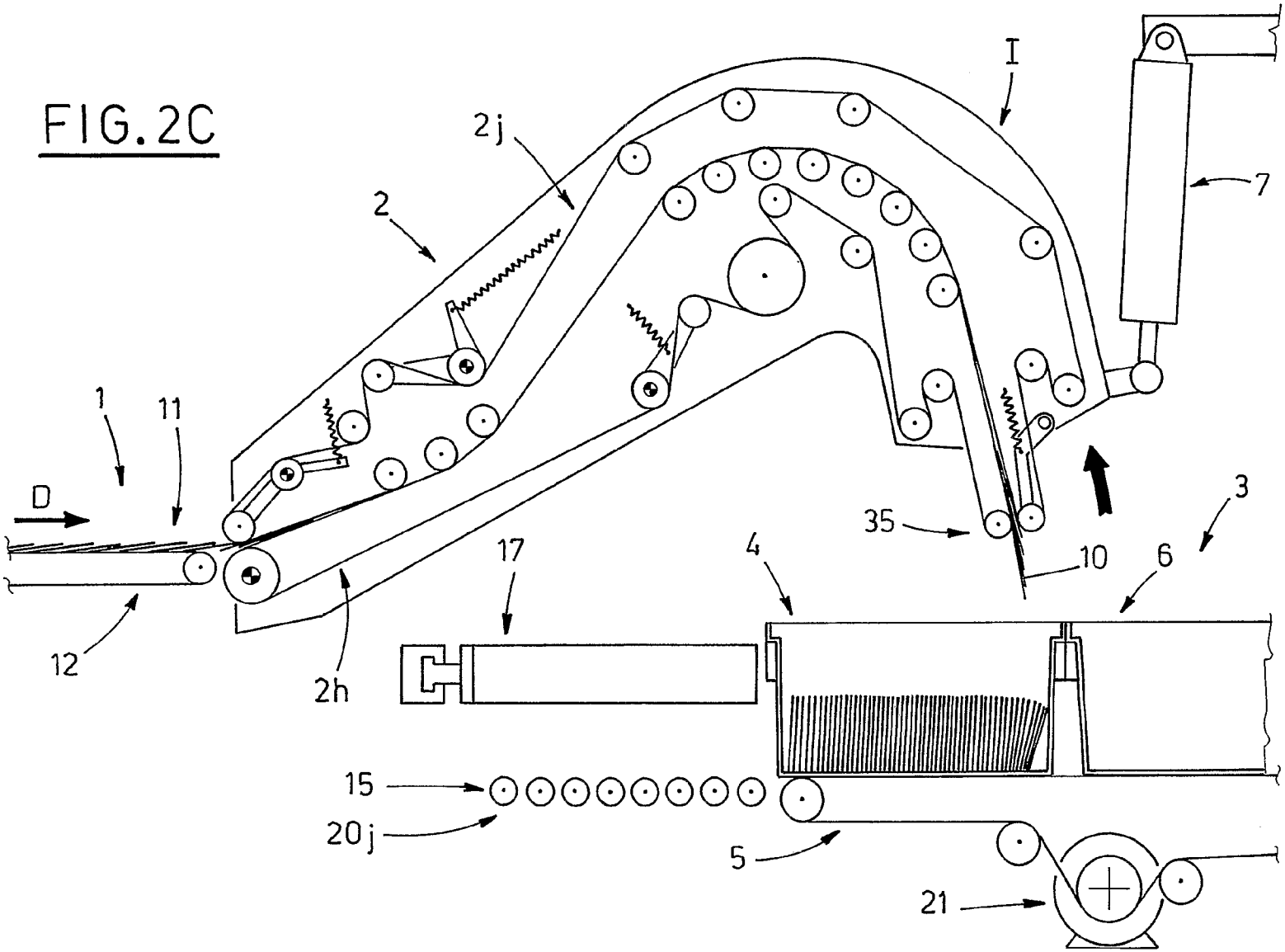
Figure 2D:
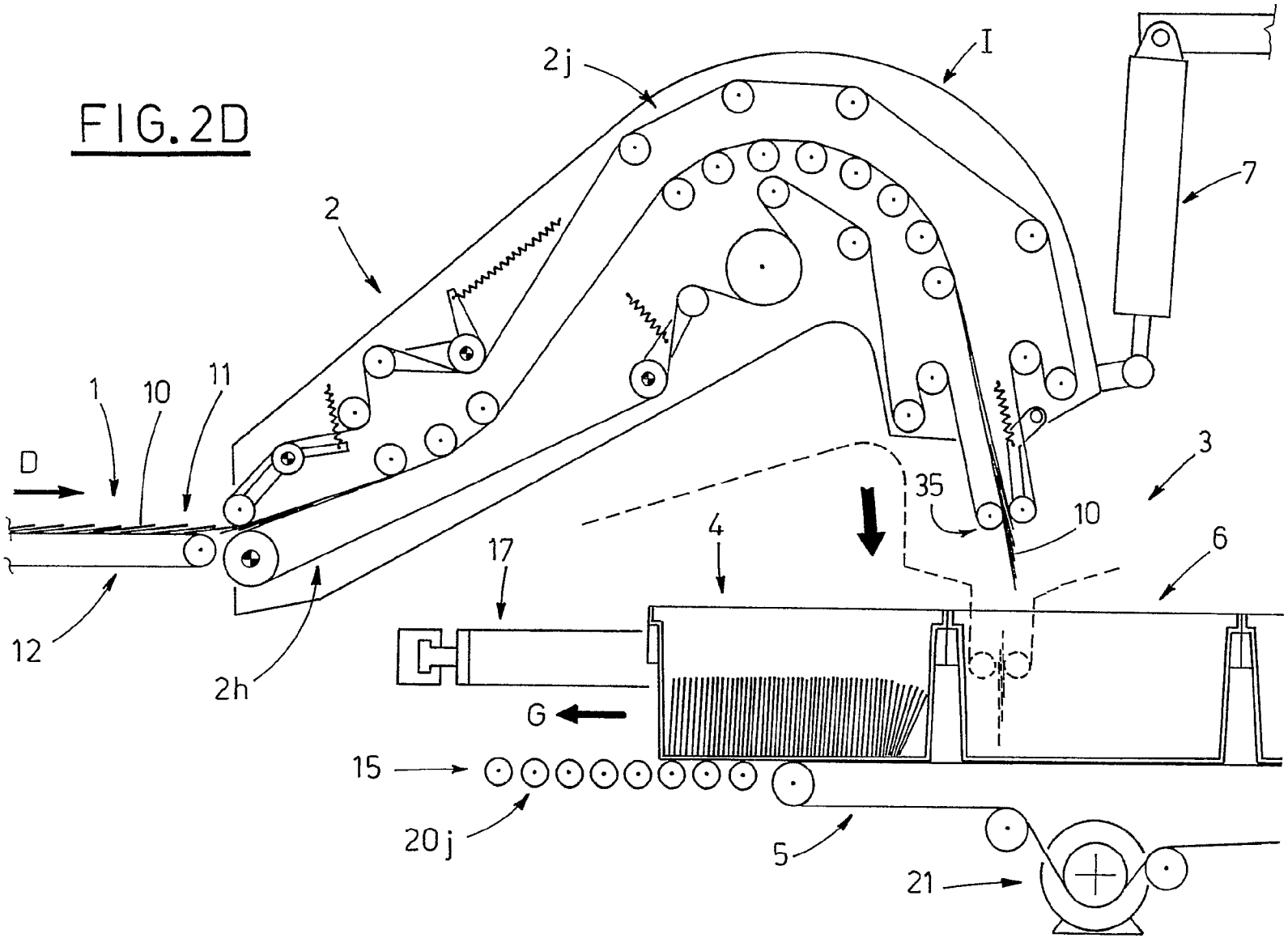

During the work configuration A, in which the article feeding apparatus 2 feeds the articles 10 to a box-like container, in the example shown in FIG. 2A the first box-like container 4, a filling station 3 is functionally defined between the terminal portion 35 of the apparatus 2 and the first supporting and driving means 5, in the space, where the containers are filled.

As it has already been said, a prefixed step relation occurs between the article feeding apparatus 2 and the first supporting and driving means 5, adjusted by the sensor means 8.

The sensor means 8 checks the vertical section 8*j* and in case of detection of a portion of an article 10, operate the first supporting and driving means 5, which consequently work intermittently.

When the apparatus is in the work configuration A, the terminal portion 35 of the apparatus 2 feeds the articles 10, each partially beside another, into the first box-like container 4 (see FIG. 4A).

A generic article 10, just released by the pair of conveyors 2*h*, 2*j*, on one side touches another article 10 of the quantity of articles 10 already placed in the first container 4, arranged side by side and vertically, and on the other side, it is kept in vertical position by the plurality of articles 10, partially side by side, still held by the terminal portion 35 of the feeding apparatus 2, so as to define a stable "group".

The vertical arrangement of the above quantity of articles 10 and of the generic article 10 is ensured by the wall of the first container 4 and by the group of articles 10.

Still with reference to FIG. 4A, the first supporting and driving means 5 remain disabled, until an article 10, or its portion, passes through the vertical section 8*j*.

Consequently, the continuous feeding of articles 10 into the first box-like container 4 determines a continuous gathering of the articles, until the situation shown in FIG. 4B occurs, when the above group is diverged with respect to the vertical orientation, by the already placed quantity of articles 10, which results in occupying the vertical detecting section 8*j* and operating of the first supporting and driving means 5.

In this way, the first box-like container 4 is moved by the first supporting and driving means 5, in accordance with its filling, until a prefixed level is reached (FIG. 2B), e.g. defined by the number of elementary angular steps performed by the shaft of the motor 21 during the filling of the first container 4.

At this point, the rest stop I of the apparatus 2 begins, during which the pair of conveyors 2*h*, 2*j* are deactivated, simultaneously with the deactivation of the second conveying means 14*h*, 14*j*, then the apparatus 2 is disengaged from the first container 4 and consequently engaged with the second box-like container 6, in step relation with the operation of the first supporting and driving means 5, as already explained.

During the rest configuration 1, the second conveying means 14*h*, 14*j* remain deactivated and the articles 10, moved by the first conveying means 12, operated continuously, concentrate on the support 13, where a more extended overlapping of the articles 10 occurs; this means that during the subsequent active step A, the feeding apparatus 2 is aimed at transferring the articles 10 into the second box-like container 6, according to different overlapping extension, and consequently, the speed of the first supporting and driving means 5 varies within a precise range.

This allows the conveying line 20 and the first conveying means 12 to work continuously, differently from the prior art apparatuses, which results in higher productivity of the present invention with respect to known apparatuses.

The first box-like container 4, so filled with a prefixed quantity of articles 10, is pushed by the first supporting and driving means 5, after the beginning of the rest position 1, onto the first dwelling station 15, resting on the rollers 20*j*, and then, it is transferred, by the first pushing means 17, onto the second dwelling station 16.

As it has already been said, the first box-like container 4 is transferred from the second dwelling station 16 (see FIG. 1), by the second pushing means 19, onto the second support and driving means 18, whose task is to transfer the container 4 toward the machine outlet, in a feeding direction F, for subsequent working steps.

The above made considerations refer to an operation cycle, in which a first box-like container 4 is filled; the same description is valid for any generic operation cycle.

Figure 5:
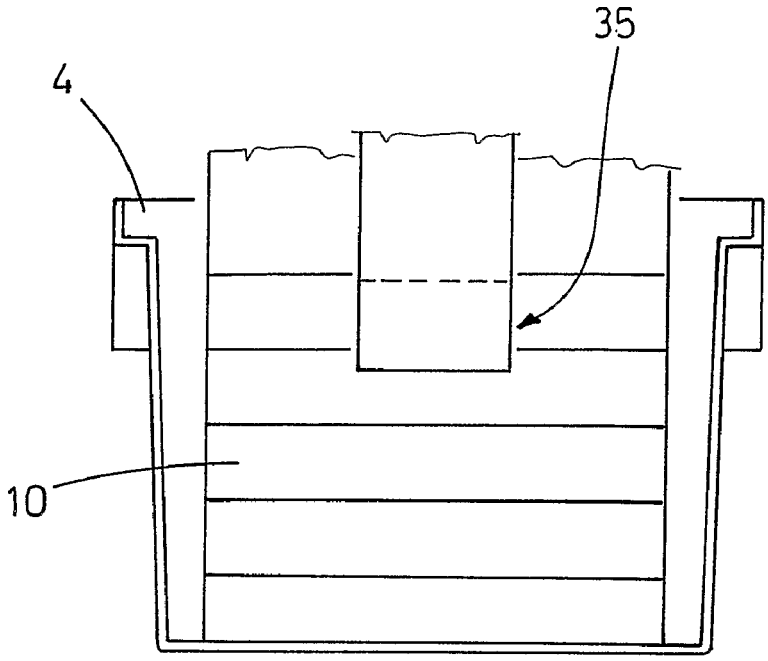
FIGS. 5, 6 are enlarged views of box-like containers with the articles, during the machine operation.
Figure 6:
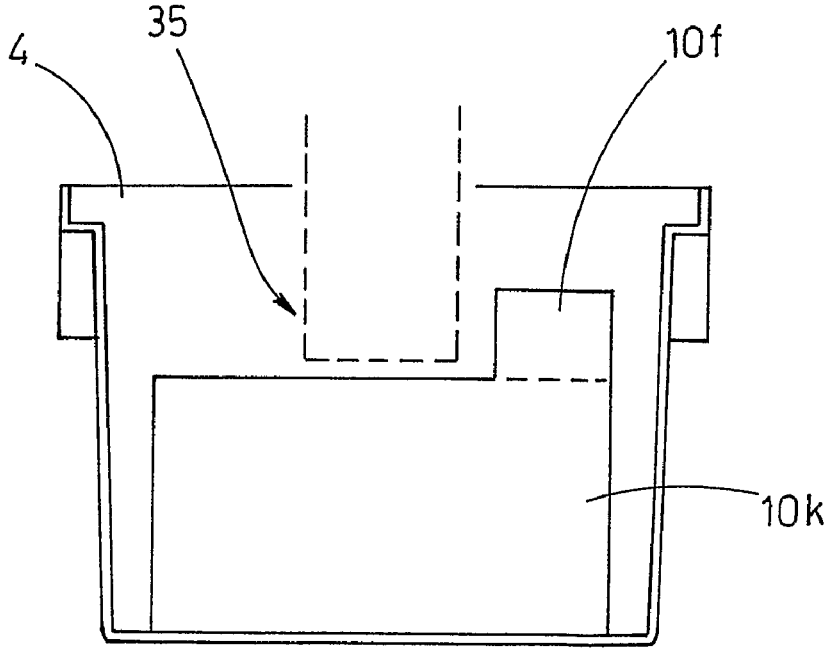

The conveyors 2*h*, 2*j* have a width considerably shorter than the width of the envelopes 10, as seen in FIGS. 5, 6, leaving the lateral portions thereof free.

In this way, it is possible to use not only generic articles 10, but also articles 10*k*, having at least one lateral protrusion 10*f*.

This allows e.g. to separate the quantities of envelopes destined to different geographical areas, thus simplifying the processing steps, to which the first container 4 is subjected at the outlet of the proposed machine.

The height of the terminal portion 35 of the apparatus 2 with respect to the bottom of the box-like container can be varied in relation to the size of the articles 10; it can be defined by adjusting the operating means 7, which can be enabled e.g. by a suitable control board.

In this way, the operator can organize the change of size of the articles 10 in a rapid and simple way, directly from the control board and even without slowing down the production rate.

Finally, it is possible to arrange, e.g. upstream of the article feeding apparatus 2, sensor means for detecting the envelope size and controlling the automatic adjustment of the operation means 7 during the active step A of the apparatus 2.

Therefore, in the last case, the whole process becomes completely automatic and the time usually needed to change the size is minimal, or even eliminated.

The method, which performs the filling of box-like containers with articles arranged side by side and vertically uses the above mentioned article feeding apparatus 2 and the first means 5 for supporting and moving a series of box-like containers; the method includes:

placing a first box-like container 4, belonging to the series of the box-like containers, at the article feeding apparatus 2;

feeding articles 10, by the article feeding apparatus 2, into the first box-like container 4 with a vertical orientation, in step relation with the motion of the latter in a feeding direction G, until a prefixed filling condition of the first container 4 is reached;

stopping the feeding of the articles 10 fed by the article feeding apparatus 2;

removing the article feeding apparatus 2 from the first box-like container 4 and moving the latter and the second box-like container 6, belonging to the series of box-like containers and adjacent to the first container 4, in a feeding direction G, by the first supporting and driving means 5;

introduction of the article feeding apparatus 2 into the second box-like container 6.

A station 1 is situated upstream of the article feeding apparatus 2 for forming a row 11 of articles 10, overlapped at least partially one with respect to another, on first conveying means 12, which are aimed at moving the row 11 to the inlet of the article feeding apparatus 2.

This way, when the feeding of the articles 10 fed by the apparatus 2 is stopped, a part of articles 10 of the row 11 on the forming station 1 are only more overlapped, without any effect on the working of the feeding line 20, which, together with the first conveying means 12, maintains its normal continuous operation, without any slowing down.

To carry out the method, also a sensor means 8 is required: the step relation between the article feeding apparatus 2 and the first supporting and driving means 5 is defined by the detection of the presence of at least a part of the articles 10 in a position corresponding to a vertical detection section 8*j*.

The advantage of the present invention lies in the fact that it conceives a machine for filling box-like containers with articles arranged side by side and vertically, which is capable of transferring articles from a feeding line into relative box-like containers, placing them side by side vertically, without causing any stops or slowing down of the flow of articles on the feeding line 20.

Another advantage of the invention lies in the fact that it conceives a compact machine, with reduced dimensions and essential structure, which is capable of implementing the proper functions of the apparatuses of the prior art at relatively limited costs.

A further advantage of the invention results from the fact that it conceives a machine, which is capable of minimizing, and even eliminating, the times usually required for performing the articles size change during their processing; this advantage allows higher automation degree and bigger processing rate with respect to prior art apparatuses.

Yet a further advantage of the invention results from having conceived a method for filling box-like containers with articles arranged side by side and vertically, which allows the articles to be aligned inside the box-like containers side by side and vertically, by a cyclical and automatic process of high production rate.

It is understood that what above, has been described as a not limiting example, therefore, possible practical-application variants remain within the protective scope of the invention as described above and claimed below.

The invention claimed is:

1. A method for filling a series of box-like containers with articles arranged side by side and vertically, the method comprising:

providing an article feeding apparatus (2) and first means (5) for supporting and moving box-like containers placing said article feeding apparatus (2) in a position corresponding to a first box-like container (4), belonging to the series of the box-like containers;

inserting the articles (10) supplied by the article feeding apparatus (2) into a first box-like container (4), in a vertical orientation, in step relation with the movement of the first box-like container in a container feeding direction (G), until a prefixed filling condition of the first box-like container (4) is achieved;

stopping the feeding of the articles (10) by the article feeding apparatus (2);

removing said article feeding apparatus (2) from the first box-like container (4) and moving at least said first box-like container (4) and a second box-like container (6), belonging to the series of box-like containers and adjacent to the first box-like container (4) in a feeding direction (G), using the first supporting and moving means (5);

placing the article feeding apparatus (2) in a position corresponding to the second box-like container (6);

providing a first dwelling station (15), situated in cascade with respect to the first supporting means (5);

providing a second dwelling station (16), situated beside the first dwelling station (15);

providing first pushing means (17), connected to said first dwelling station (15), for transferring the box-like containers, belonging to the series of box-like containers, from said first dwelling station (15) to said second dwelling station (16);

providing second support and moving means (18) for supporting and moving the series of box-like containers in a feeding direction (F), substantially opposite to said article feeding direction (G), and having an initial section adjacent to the second dwelling station (16);

operating second pushing means (19), connected to said second dwelling station (16), in step relation with an activation of said first pushing means (17) for transferring the box-like containers, belonging to the series of box-like containers, from said second dwelling station (16) onto said second support and moving means (18).

2. A method, as claimed in claim 1, further comprising providing a station (1) for forming a row (11) of articles (10), overlapped at least partially, on first conveying means (12) for transferring said row (11) to the inlet of the article feeding apparatus (2), wherein stopping of feeding said articles (10), fed by the article feeding apparatus (2), makes at least a portion of the articles (10) of said row (11) more overlapped in the forming station (1).

3. A method, as claimed in claim 1, further comprising providing sensor means (8) connected to said article feeding apparatus (2), for defining said step relation occurring between said article feeding apparatus (2) and said first supporting means (5) when presence of at least a portion of said articles (10) in a vertical detection section (**8*j***) is detected.

4. A machine for filling box-like containers with articles arranged side by side and vertically, the machine comprising:

a row forming station (1) for forming a row (11) of articles (10), overlapped at least partially, on a first conveying means (12), the row (11) transferred by the first conveying means toward an outlet section of the row forming station (1), in a forward direction (D);

an article feeding apparatus (2), functionally interposed between said outlet section of said row forming station (1) and a filling station (3), and operating between a rest configuration (I) and a work configuration (A), said articles (10) being transferred from said outlet section into a box-like container (4), belonging to a series of box-like containers, placed in said filling station (3) by said article feeding apparatus when in the work configuration, said articles being placed in a vertical orientation to define a prefixed filling condition of a first box-like container (4);

first means (5) for supporting said series of box-like containers, arranged one after another, and for moving the box-like containers in a feeding direction (G), in step relation with a speed of feeding of said articles (10), fed by the article feeding apparatus (2);

a first dwelling station (15), situated in cascade with respect to the first supporting means (5);

a second dwelling station (16), situated beside the first dwelling station (15);

first pushing means (17), connected to said first dwelling station (15), to transfer the box-like containers, belonging to the series of box-like containers, from said first dwelling station (15) to said second dwelling station (16);

second support and moving means (18) for supporting and moving the series of box-like containers, operated in a feeding direction (F), substantial opposite to said article feeding direction (G), and having an initial section adjacent to the second dwelling station (16);

second pushing means (19). connected to said second dwelling station (16), operated in step relation with an activation of said first pushing means (17) to transfer the box-like containers, belonging to the series of box-like containers, from said second dwelling station (16) onto said second support and moving means (18).

5. A machine, as claimed in claim 4 wherein said article feeding apparatus (2) includes a pair of conveyors (**2*h*, 2*j*), a lower conveyor and an upper conveyor arranged mutually to define two facing runs for conveying the articles from said outlet section of the forming station into the box-like container (4**).

6. A machine, as claimed in claim 5, wherein said conveyors (**2*h*, 2*j*) of the feeding apparatus (2) are less wide than the articles (10) leaving lateral portions of said articles free, for processing also articles (10*k*) having at least one lateral protrusion (10*f***).

7. A machine, as claimed in claim 4, wherein said article feeding apparatus (2) is movable, at least in its terminal part, along the article transfer direction to allow removal from the first box-like container, the article feeding apparatus moved to the rest configuration (I), the article feeding apparatus being subsequently movable for introduction into a second box-like container (6), belonging to said series of box-like containers, which is positioned adjacent to the first box-like container (4).

8. A machine, as claimed in claim 4, wherein said article feeding apparatus (2) is hinged near the outlet section of said row forming station (1) and is made to swing by operation means (7), to allow, in the rest configuration (I), removal from said first box-like container (4), and subsequent introduction into a second box-like container (6), belonging to said series of box-like containers, which is positioned adjacent to the first box-like container (4).

9. A machine, as claimed in claim 4, further comprising sensor means (8), connected to said article feeding apparatus (2) to detect, through a vertical detection section (8*j*), the presence of at least one portion of said articles (10).

10. A machine, as claimed in claim 4, wherein the terminal part of the row forming station (1) includes a support (13) for the articles (10), situated in cascade with said first conveying means (12) with respect to the forward direction (D), and also second conveying means (14*j*, 14*h*), situated beside the support (13), to move, by sliding, said articles (10), resting on the support (13), up to the outlet section of the row station (1), said second conveying means (14*j*, 14*h*) being operated in step relation with the feeding of the articles (10) by the feeding apparatus (2), to stop feeding, corresponding to disabling the second conveying means (14*j*, 14*h*), to obtain more overlapped articles (10), at least on the support (13).

11. A machine, as claimed in claim 4, wherein said first and second dwelling stations include series of rollers (20*j*, 20*h*).

* * * * *